US009953661B2

(12) United States Patent
Vickers

(10) Patent No.: US 9,953,661 B2
(45) Date of Patent: Apr. 24, 2018

(54) NEURAL NETWORK VOICE ACTIVITY DETECTION EMPLOYING RUNNING RANGE NORMALIZATION

(71) Applicant: Cirrus Logic Inc., Austin, TX (US)

(72) Inventor: Earl Vickers, San Jose, CA (US)

(73) Assignee: CIRRUS LOGIC INC., Austin, TX (US)

( * ) Notice: Subject to any disclaimer, the term of this patent is extended or adjusted under 35 U.S.C. 154(b) by 0 days.

(21) Appl. No.: 14/866,824

(22) Filed: Sep. 25, 2015

(65) Prior Publication Data

US 2016/0093313 A1 Mar. 31, 2016

Related U.S. Application Data

(60) Provisional application No. 62/056,045, filed on Sep. 26, 2014.

(51) Int. Cl.
*G10L 21/02* (2013.01)
*G10L 21/0264* (2013.01)
(Continued)

(52) U.S. Cl.
CPC ..... *G10L 21/0264* (2013.01); *G10L 21/0224* (2013.01); *G10L 25/60* (2013.01);
(Continued)

(58) Field of Classification Search
CPC ..... G10L 25/78; G10L 21/0208; G10L 2025/786; G10L 15/20; G10L 25/93
See application file for complete search history.

(56) References Cited

U.S. PATENT DOCUMENTS 6,772,117 B1 * 8/2004 Laurila ..... G10L 15/20 704/233
8,223,988 B2 * 7/2012 Wang ..... G10L 21/028 381/111

(Continued)

FOREIGN PATENT DOCUMENTS

WO 2012097016 7/2012
WO 2013142659 9/2013

OTHER PUBLICATIONS

International Search Report and Written Opinion for International Application No. PCT/US2015/052519, dated Dec. 22, 2015, 8 pages.

*Primary Examiner* — Richemond Dorvil
*Assistant Examiner* — Mark Villena
(74) *Attorney, Agent, or Firm* — Kirk Dorius; Dorius Law P.C.

(57) ABSTRACT

A "running range normalization" method includes computing running estimates of the range of values of features useful for voice activity detection (VAD) and normalizing the features by mapping them to a desired range. Running range normalization includes computation of running estimates of the minimum and maximum values of VAD features and normalizing the feature values by mapping the original range to a desired range. Smoothing coefficients are optionally selected to directionally bias a rate of change of at least one of the running estimates of the minimum and maximum values. The normalized VAD feature parameters are used to train a machine learning algorithm to detect voice activity and to use the trained machine learning algorithm to isolate or enhance the speech component of the audio data.

17 Claims, 6 Drawing Sheets

(51) Int. Cl.

| | |
|---|---|
| ***G10L 21/0224*** | (2013.01) |
| ***G10L 25/60*** | (2013.01) |
| ***G10L 25/84*** | (2013.01) |
| ***G10L 25/78*** | (2013.01) |
| *G10L 25/30* | (2013.01) |
| *G10L 15/06* | (2013.01) |

(52) U.S. Cl.
CPC ..... *G10L 25/78* (2013.01); *G10L 25/84* (2013.01); *G10L 25/30* (2013.01); *G10L 2015/0636* (2013.01)

(56) References Cited

U.S. PATENT DOCUMENTS 9,305,567 B2 * 4/2016 Visser ..... G10L 21/0208
9,401,160 B2 * 7/2016 Sehlstedt ..... G10L 25/78
2002/0123308 A1 * 9/2002 Feltstrom ..... H04B 15/005 455/63.1
2005/0182621 A1 8/2005 Zlokamik et al.
2008/0240282 A1 10/2008 Lin
2010/0174540 A1 * 7/2010 Seefeldt ..... H03G 3/3005 704/224
2010/0177956 A1 * 7/2010 Cooper ..... G06K 9/00664 382/159
2010/0211388 A1 8/2010 Yu et al.
2010/0280827 A1 * 11/2010 Mukerjee ..... G10L 15/142 704/236
2011/0081026 A1 * 4/2011 Ramakrishnan .... G10L 21/0208 381/94.3
2011/0125490 A1 * 5/2011 Furuta ..... G10L 21/0232 704/205
2012/0130713 A1 * 5/2012 Shin ..... G10L 25/78 704/233
2012/0209601 A1 * 8/2012 Jing ..... G10L 21/0364 704/226
2012/0215536 A1 * 8/2012 Sehlstedt ..... G10L 25/78 704/246
2013/0231932 A1 * 9/2013 Zakarauskas ..... G10L 25/78 704/236
2014/0193071 A1 * 7/2014 Cho ..... G06K 9/00771 382/170
2015/0032446 A1 * 1/2015 Dickins ..... G10L 25/78 704/233
2015/0039304 A1 * 2/2015 Wein ..... G10L 25/78 704/233
2015/0127335 A1 * 5/2015 Ubale ..... G10L 25/78 704/231
2015/0213811 A1 * 7/2015 Elko ..... H04R 3/005 381/92
2015/0221322 A1 * 8/2015 Iyengar ..... G10L 25/84 704/226
2015/0262574 A1 * 9/2015 Terao ..... G10L 25/63 704/246
2016/0203833 A1 * 7/2016 Zhu ..... G10L 25/78 704/233

* cited by examiner

NEURAL NETWORK VOICE ACTIVITY DETECTION EMPLOYING RUNNING RANGE NORMALIZATION

CROSS-REFERENCE TO RELATED APPLICATION

This application claims priority to U.S. provisional application Ser. No. 62/056,045 filed Sep. 26, 2014 and titled "Neural Network Voice Activity Detection Employing Running Range Normalization," which is incorporated herein in its entirety by reference.

TECHNICAL FIELD

This disclosure relates generally to techniques for processing audio signals, including techniques for isolating voice data, removing noise from audio signals, or otherwise enhancing the audio signals prior to outputting the audio signals. More specifically, this disclosure relates to voice activity detection (VAD) and, even more specifically, to methods for normalizing one or more voice activity detection features or feature parameters derived from an audio signal. Apparatuses and systems for processing audio signals are also disclosed.

BACKGROUND

Voice activity detectors have long been used to enhance speech in audio signals and for a variety of other purposes including speech recognition or recognition of a particular speaker's voice.

Conventionally, voice activity detectors have relied upon fuzzy rules or heuristics in conjunction with features such as energy levels and zero-crossing rates to make a determination as to whether or not an audio signal includes speech. In some cases, the thresholds employed by conventional voice activity detectors are dependent upon the signal-to-noise ratio (SNR) of an audio signal, making it difficult to choose appropriate thresholds. In addition, while conventional voice activity detectors work well under conditions where an audio signal has a high SNR, they are less reliable when the SNR of the audio signal is low.

Some voice activity detectors have been improved by the use of machine learning techniques, such as neural networks, which typically combine several mediocre voice activity detection (VAD) features to provide a more accurate voice activity estimate. (The term "neural network," as used herein, may also refer to other machine learning techniques, such as support vector machines, decision trees, logistic regression, statistical classifiers, etc.) While these improved voice activity detectors work well with the audio signals that are used to train them, they are typically less reliable when applied to audio signals that have been obtained from different environments, that include different types of noise or that include a different amount of reverberation than the audio signals that were used to train the voice activity detectors.

A technique known as "feature normalization" has been used to improve the robustness with which a voice activity detector may be used in evaluating audio signals with a variety of different characteristics. In Mean-Variance Normalization (MVN), for example, the means and the variances of each element of the feature vectors are normalized to zero and one, respectively. In addition to improving robustness to different data sets, feature normalization implicitly provides information about how the current time frame compares to previous frames. For example, if an unnormalized feature in a given isolated frame of data has a value of 0.1, that may provide little information about whether this frame corresponds to speech or not, especially if we don't know the SNR. However, if the feature has been normalized based on the long-term statistics of the recording, it provides additional context about how this frame compares to the overall signal.

However, traditional feature normalization techniques such as MVN are typically very sensitive to the percentage of an audio signal that corresponds to speech (i.e., the percentage of time that a person is speaking). If the online speech data during runtime has a significantly different percentage of speech than the data that was used to train the neural network, the mean values of the VAD features will be shifted correspondingly, producing misleading results. Accordingly, improvements are sought in voice activity detection and feature normalization.

SUMMARY OF THE INVENTION

One aspect of the invention features, in some embodiments, a method of obtaining normalized voice activity detection features from an audio signal. The method is performed at a computing system and includes the steps of dividing an audio signal into a sequence of time frames; computing one or more voice activity detection feature of the audio signal for each of the time frames; and computing running estimates of minimum and maximum values of the one or more voice activity detection feature of the audio signal for each of the time frames. The method further includes computing input ranges of the one or more voice activity detection feature by comparing the running estimates of the minimum and maximum values of the one or more voice activity detection feature of the audio signal for each of the time frames; and mapping the one or more voice activity detection feature of the audio signal for each of the time frames from the input ranges to one or more desired target range to obtain one or more normalized voice activity detection feature.

In some embodiments, the one or more features of the audio signal indicative of spoken voice data includes one or more of full-band energy, low-band energy, ratios of energies measured in primary and reference microphones, variance values, spectral centroid ratios, spectral variance, variance of spectral differences, spectral flatness, and zero crossing rate.

In some embodiments, the one or more normalized voice activity detection feature is used to produce an estimate of the likelihood of spoken voice data.

In some embodiments, the method further includes applying the one or more normalized voice activity detection feature to a machine learning algorithm to produce a voice activity detection estimate indicating at least one of a binary speech/non-speech designation and a likelihood of speech activity.

In some embodiments, the method further includes using the voice activity detection estimate to control an adaptation rate of one or more adaptive filters.

In some embodiments, the time frames are overlapping within the sequence of time frames.

In some embodiments, the method further includes post-processing the one or more normalized voice activity detection feature, including at least one of smoothing, quantizing, and thresholding.

In some embodiments, the one or more normalized voice activity detection feature is used to enhance the audio signal by one or more of noise reduction, adaptive filtering, power level difference computation, and attenuation of non-speech frames.

In some embodiments, the method further includes producing a clarified audio signal comprising the spoken voice data substantially free of non-voice data.

In some embodiments, the one or more normalized voice activity detection feature is used to train a machine learning algorithm to detect speech.

In some embodiments, computing running estimates of minimum and maximum values of the one or more voice activity detection feature includes applying asymmetrical exponential averaging to the one or more voice activity detection feature. In some embodiments, the method further includes setting smoothing coefficients to correspond to time constants selected to produce one of a gradual change and a rapid change in one of smoothed minimum value estimates and smoothed maximum value estimates. In some embodiments, the smoothing coefficients are selected such that continuous updating of a maximum value estimate responds rapidly to higher voice activity detection feature values and decays more slowly in response to lower voice activity detection feature values. In some embodiments, the smoothing coefficients are selected such that continuous updating of a minimum value estimate responds rapidly to lower voice activity detection feature values and increases slowly in response to higher voice activity detection feature values.

In some embodiments, the mapping is performed according to the following formula: normalizedFeatureValue=2×(newFeatureValue−featureFloor)/(featureCeiling−featureFloor)−1.

In some embodiments, the mapping is performed according to the following formula: normalizedFeatureValue=(newFeatureValue−featureFloor)/(featureCeiling−featureFloor).

In some embodiments, the computing input ranges of the one or more voice activity detection feature is performed by subtracting the running estimates of the minimum values from the running estimates of the maximum values.

Another aspect of the invention features, in some embodiments, a method of normalizing voice activity detection features. The method includes the steps of segmenting an audio signal into a sequence of time frames; computing running minimum and maximum value estimates for voice activity detection features; computing input ranges by comparing the running minimum and maximum value estimates; and normalizing the voice activity detection features by mapping the voice activity detection features from the input ranges to one or more desired target ranges.

In some embodiments, computing running minimum and maximum value estimates comprises selecting smoothing coefficients to establish a directionally-biased rate of change for at least one of the running minimum and maximum value estimates.

In some embodiments, the smoothing coefficients are selected such that the running maximum value estimate responds more quickly to higher maximum values and more slowly to lower maximum values.

In some embodiments, the smoothing coefficients are selected such that the running minimum value estimate responds more quickly to lower minimum values and more slowly to higher minimum values.

Another aspect of the invention features, in some embodiments, a computer-readable medium storing a computer program for performing a method for identifying voice data within an audio signal, the computer-readable medium including: computer storage media; and computer-executable instructions stored on the computer storage media, which computer-executable instructions, when executed by a computing system, are configured to cause the computing system to compute a plurality of voice activity detection features; compute running estimates of minimum and maximum values of the voice activity detection features; compute input ranges of the voice activity detection features by comparing the running estimates of the minimum and maximum values; and map the voice activity detection features from the input ranges to one or more desired target ranges to obtain normalized voice activity detection features.

BRIEF DESCRIPTIONS OF THE DRAWINGS

A more complete understanding of the present invention may be derived by referring to the detailed description when considered in connection with the Figures, and FIG. 1 illustrates a voice activity detection method employing running range normalization according to one embodiment;

DETAILED DESCRIPTION

Figure 1:
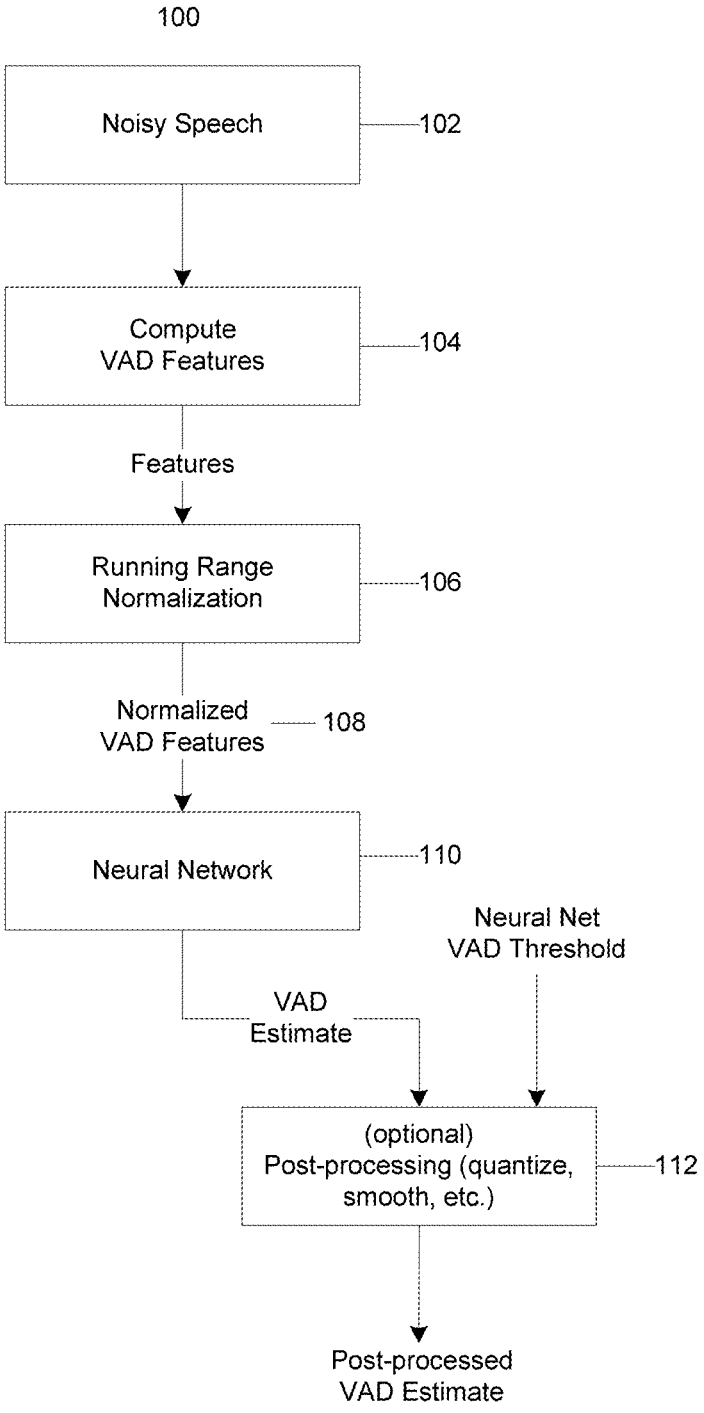

The following description is of exemplary embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

The present invention extends to methods, systems, and computer program products for analyzing digital data. The digital data analyzed may be, for example, in the form of digital audio files, digital video files, real time audio streams, and real time video. streams, and the like. The present invention identifies patterns in a source of digital data and uses the identified patterns to analyze, classify, and filter the digital data, e.g., to isolate or enhance voice data. Particular embodiments of the present invention relate to digital audio. Embodiments are designed to perform non-destructive audio isolation and separation from any audio source In one aspect, a method is disclosed for continuously normalizing one or more features that are used to determine the likelihood that an audio signal (e.g., an audio signal received by a microphone of an audio device, such as a telephone, a mobile telephone, audio recording equipment or the like; etc.) includes audio that corresponds to an individual's voice, which is referred to in the art as "voice activity detection" (VAD). Such a method includes a process referred to herein as "running range normalization," which includes tracking and, optionally, continuously modifying, the parameters of features of the audio signal that are likely to describe various aspects of an individual's voice. Without limitation, running range normalization may include computation of running estimates of the minimum and maximum values of one or more features of an audio signal (i.e., a feature floor estimate and a feature ceiling estimate, respectively) that may indicate that an individual's voice makes up at least part of the audio signal. Since the features of interest are indicative of whether or not an audio signal includes an individual's voice, these features may be referred to as "VAD features." By tracking and modifying the floor and ceiling estimates for a particular VAD feature, a level of confidence as to whether or not certain features of an audio signal indicate the presence of spoken voice may be maximized.

Some non-limiting examples of VAD features include full-band energy, energies in various bands including low-band energy (e.g., <1 kHz), ratios of energies measured in primary and reference microphones, variance values, spectral centroid ratios, spectral variance, variance of spectral differences, spectral flatness, and zero-crossing rate.

With reference to FIG. 1, an embodiment of a VAD method 100 is illustrated. A VAD method may include obtaining one or more audio signals ("Noisy speech") that can be divided into a sequence of (optionally overlapping) time frames. (Step 102). In some embodiments, the audio signal may be subjected to some enhancement processing before a determination is made as to whether or not the audio signal includes voice activity. At each time frame, each audio signal may be evaluated to determine, or compute, one or more VAD features (at "Compute VAD Features"). (Step 104). With the VAD feature(s) from a particular time frame, a running range normalization process may be performed on those VAD features (at "Running range normalization"). (Step 106). The running range normalization process may include computing a feature floor estimate and a feature ceiling estimate for that time frame. By mapping to a range between the feature floor estimate and the feature ceiling estimate, the parameters for the corresponding VAD feature may be normalized over a plurality of time frames, or over time ("normalized VAD features"). (Step 108).

The normalized VAD features may then be used (e.g., by a neural network, etc.) to determine whether or not the audio signal includes a voice signal. This process may be repeated to continuously update the voice activity detector while an audio signal is being processed.

Given a sequence of normalized VAD features, a neural network may produce a VAD estimate, indicating a binary speech/non-speech decision, a likelihood of speech activity, or a real number that may optionally be subjected to a threshold to produce a binary speech/non-speech decision. (Step 110). The VAD estimate produced by the neural network may be subjected to further processing, such as quantization, smoothing, thresholding, "orphan removal," etc., producing a post-processed VAD estimate that may be used to control further processing of the audio signal. (Step 112). For example, if no voice activity is detected in an audio signal or a portion of the audio signal, other sources of audio in the audio signal (e.g., noise, music, etc.) may be removed from the relevant portion of the audio signal, resulting in a silent audio signal. The VAD estimate (with optional post-processing) may also be used to control the adaptation rate of adaptive filters or to control other speech enhancement parameters.

An audio signal may be obtained with a microphone, with a receiver, as an electrical signal or in any other suitable manner. The audio signal may be transmitted to a computer processor, a microcontroller or any other suitable processing element, which, when operating under control of appropriate programming, may analyze and/or process the audio signal in accordance with the disclosure provided herein.

As a non-limiting embodiment, an audio signal may be received by one or more microphones of an audio device, such as a telephone, a mobile telephone, audio recording equipment or the like. The audio signal may be converted to a digital audio signal, and then transmitted to a processing element of the audio device. The processing element may apply a VAD method according to this disclosure to the digital audio signal and, in some embodiments, may perform other processes on the digital audio signal to further clarify, or remove noise from, the same. The processing element may then store the clarified audio signal, transmit the clarified audio signal and/or output the clarified audio signal.

In another non-limiting embodiment, a digital audio signal may be received by an audio device, such as a telephone, a mobile telephone, audio recording equipment, audio playback equipment or the like. The digital audio signal may be communicated to a processing element of the audio device, which may then execute a program that effects a VAD method according to this disclosure on the digital audio signal. Additionally, the processing element may execute one or more other processes that further improve clarity of the digital audio signal. The processing element may then store, transmit and/or audibly output the clarified digital audio signal.

Figure 2:
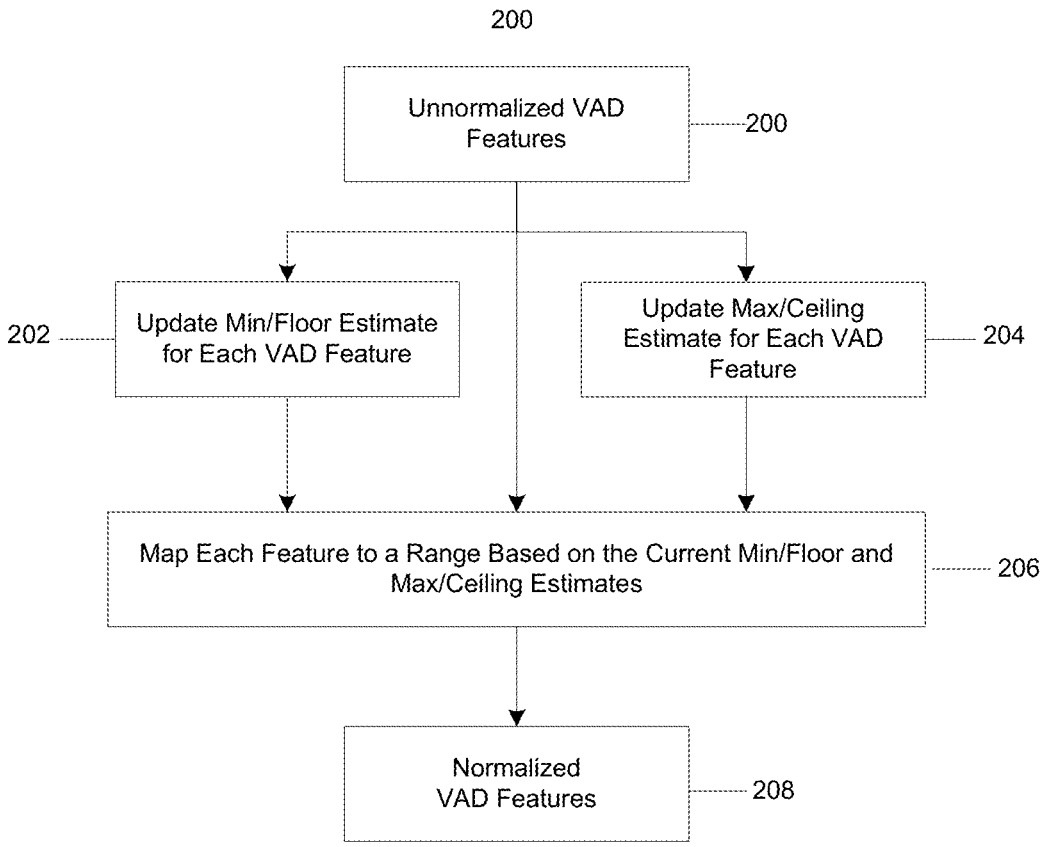
FIG. 2 illustrates a process flow of a method for using running range normalization to normalize VAD features according to one embodiment.

With reference to FIG. 2, a running range normalization process 200 is used to translate a set of unnormalized VAD features to a set of normalized VAD features. At each time frame, updated floor and ceiling estimates are computed for each feature. (Steps 202, 204). Then each feature is mapped to a range based on the floor and ceiling estimates, (Step 206) producing the set of normalized VAD features. (Step 208).

The feature floor estimate and the feature ceiling estimate may be initialized to zero. Alternatively, for optimal performance during the first few seconds of an audio signal (e.g., with an audio signal obtained in real-time), the feature floor estimate and the feature ceiling estimate could be initialized to typical values determined in advance (e.g., at the factory, etc.). Further computation of the feature floor estimates and the feature ceiling estimates (e.g., during the course of a telephone call, as an audio signal is otherwise being received and processed to detect voice and/or clarify the audio signal, etc.) may include application of asymmetrical exponential averaging to track smoothed feature floor estimates and smoothed feature ceiling estimates, respectively, over a plurality of time frames. Other methods of tracking floor and/or ceiling estimates may be used instead of asymmetrical exponential averaging. For example, the minimum statistics algorithm tracks the minimum of the noisy speech power (optionally as a function of frequency) within a finite window.

In the context of a feature floor estimate, the use of asymmetrical exponential averaging may include comparing a value of a new VAD feature from an audio signal to the feature floor estimate and, if the value of the new VAD feature exceeds the feature floor estimate, gradually increasing the feature floor estimate. A gradual increase in the feature floor estimate may be accomplished by setting a smoothing coefficient to a value that corresponds to a slow time constant, such as five (5) seconds or more. If, in the alternative, the value of the new VAD feature from the audio signal is less than the feature floor estimate, the feature floor estimate may be quickly decreased. A quick decrease in the feature floor estimate may be accomplished by setting a smoothing coefficient to a value that corresponds to a fast time constant, such as one (1) second or less. The equation that follows represents an algorithm that may be used to apply asymmetrical exponential averaging to a feature floor estimate:

$$\text{featureFloor}_{new}=c\text{Floor}\times\text{featureFloor}_{previous}+(1-c\text{Floor})\times\text{newFeatureValue}$$

where cFloor is the current floor smoothing coefficient, $\text{featureFloor}_{previous}$ is the previous smoothed feature floor estimate, newFeatureValue is the most recent unnormalized VAD feature, and $\text{featureFloor}_{new}$ is the new smoothed feature floor estimate.

In the context of a feature ceiling estimate, the use of asymmetrical exponential averaging may include comparing a value of a new VAD feature from an audio signal to the feature ceiling estimate. In the event that the new VAD feature has a value that is less than the feature ceiling estimate, the feature ceiling estimate may be gradually decreased. A gradual decrease in the feature floor estimate may be accomplished by setting a smoothing coefficient to a value that corresponds to a slow time constant, such as five (5) seconds or more. If the new VAD feature is instead greater than the feature ceiling estimate, the feature ceiling estimate may be quickly increased. A quick increase in the feature ceiling estimate may be accomplished by setting a smoothing coefficient to a value that corresponds to a fast time constant, such as one (1) second or less. In a specific embodiment, the algorithm that follows may be used to apply asymmetrical exponential averaging to a feature ceiling estimate:

$$\text{featureCeil}_{new}=c\text{Ceil}*\text{featureCeil}_{previous}+(1-c\text{Ceil})*\text{newFeatureValue}.$$

where cCeil is the current ceiling smoothing coefficient, $\text{featureCeil}_{previous}$ is the previous smoothed feature ceiling estimate, newFeatureValue is the most recent unnormalized VAD feature, and $\text{featureCeil}_{new}$ is the new smoothed feature ceiling estimate.

Figure 3:
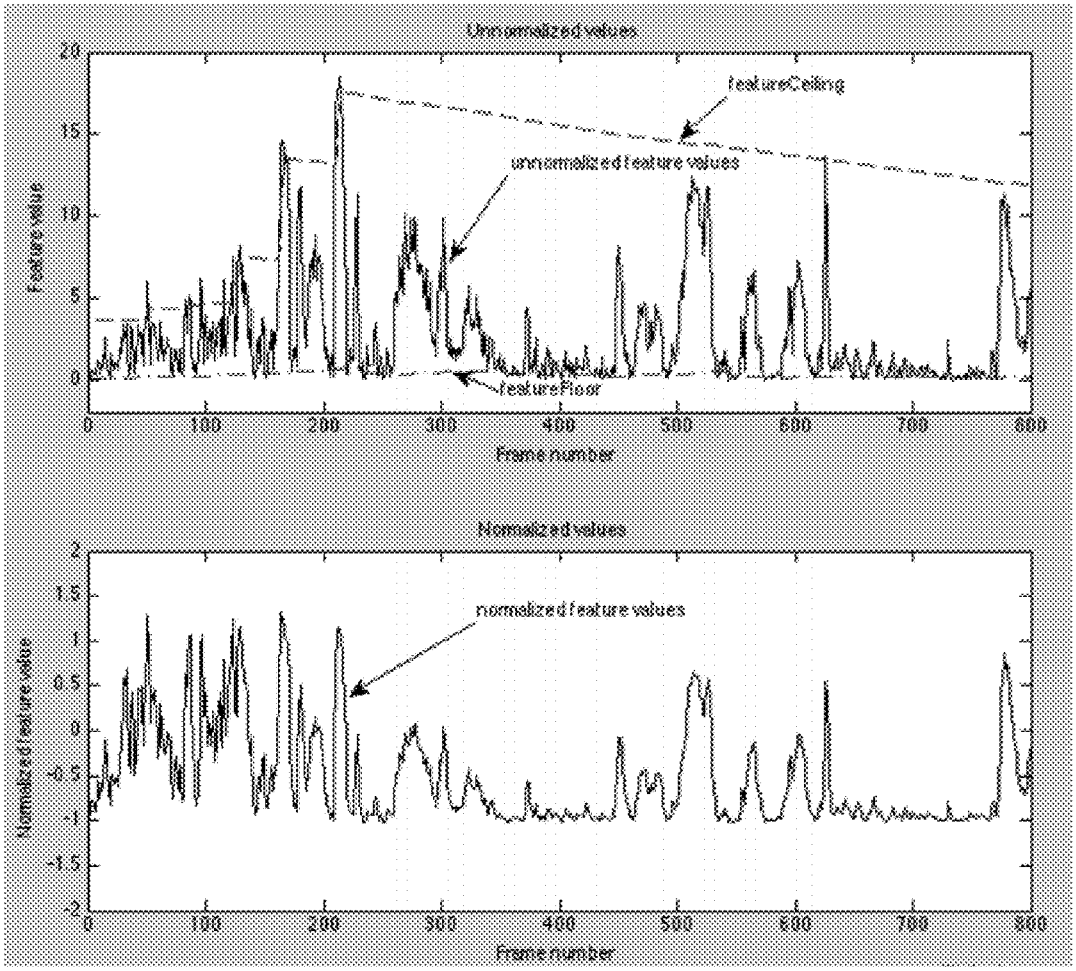
FIG. 3 illustrates the temporal variation of a typical unnormalized VAD feature, along with the corresponding floor and ceiling values and the resulting normalized VAD feature.

A typical series of unnormalized VAD feature values and the corresponding floor and ceiling values are illustrated in the top plot of FIG. 3. The solid line depicts the unnormalized VAD feature values as they vary from frame to frame; the dashed line depicts the corresponding ceiling values; and the dash-dotted line depicts the corresponding floor values. The feature ceiling estimates respond rapidly to new peaks but decay slowly in response to low feature values. Similarly, the feature floor estimates response rapidly to small feature values but increase slowly in response to large values.

The fast coefficients, typically using time constants on the order of 0.25 seconds, allow the feature floor and ceiling values to rapidly converge upon running estimates of the minimum and maximum feature values, while the slow coefficients can use much longer time constants (such as 18 seconds) than would be practical for normalization techniques such as MVN. The slow time constants make running range normalization much less sensitive to the percentage of speech, since the featureCeil value will tend to remember the maximum feature values during prolonged silences. When the talker begins speaking again, the fast time constant will help featureCeil rapidly approach the new maximum feature values. In addition, Running Range Normalization makes explicit estimates of the minimum feature values, corresponding to the noise floor. Since VAD thresholds tend to be relatively close to the noise floor, these explicit minimum feature estimates are seen to be more useful than implicit estimates attained by tracking the mean and variance. In some applications, it may be advantageous to use a different pair of time constants for the floor and ceiling estimates, e.g., to adapt the ceiling estimates more quickly than the floor estimates, or vice versa.

Once a feature floor estimate and a feature ceiling estimate have been calculated for a particular VAD feature, the VAD feature may be normalized by mapping the range between the feature floor estimate and the feature ceiling estimate to a desired target range. The desired target range may optionally extend from −1 to +1. In a specific embodiment, the mapping may be performed using the following formula:

$$normalizedFeatureValue=\left(2\times\frac{newFeatureValue-featureFloor}{featureCeiling-featureFloor}\right)-1$$

The resulting normalized feature values are depicted in the bottom plot of FIG. 3, and correspond to the unnormalized feature values in the top plot of FIG. 3. In this example, the normalized feature values tend to approximately occupy the desired target range from −1 to +1. These normalized feature values are generally more robust to varying environmental conditions and more useful for training and applying the VAD neural network.

Similarly, if the desired target range is from 0 to +1, the mapping may be performed using the following formula:

$$normalizedFeatureValue=\left(\frac{newFeatureValue-featureFloor}{featureCeiling-featureFloor}\right)$$

A variety of non-linear mappings may be used as well.

It is common for the unnormalized VAD feature value to occasionally fall outside the range between the current floor and ceiling estimates, due to the delayed response of the smoothed floor and ceiling estimates, causing the normalized VAD feature value to fall outside the desired target range. This is typically not a problem for the purpose of training and applying the neural network, but if desired, normalized feature values that are greater than the maximum value of the target range can be set to the maximum value of the target range; likewise, normalized features that are smaller than the minimum value of the target range can be set to the minimum value of the target range.

In another aspect, a VAD method, such as that disclosed above, may be used to train a voice activity detector. Such a training method may include use of a plurality of training signals, including noise signals and clean speech signals. The noise and clean speech signals may be mixed at various signal-to-noise ratios to produced noisy speech signals.

Training of a voice activity detector may include processing the noisy speech signals to determine, or compute, a plurality of VAD features therefrom. A running range normalization process, such as that disclosed previously herein, may be applied to the VAD features to provide normalized VAD features.

Separately, a voice activity detector optimized for clean speech may be applied to the plurality of clean audio signals that corresponds to the plurality of noisy audio signals. By processing the clean audio signals with the voice activity detector optimized for clean speech, ground truth data for the VAD features may be obtained.

The ground truth data and the normalized VAD features derived from the noisy audio signals may then be used to train the neural network, so it can "learn" to associate similar sets of normalized VAD features with the corresponding ground truth data.

Figure 4:
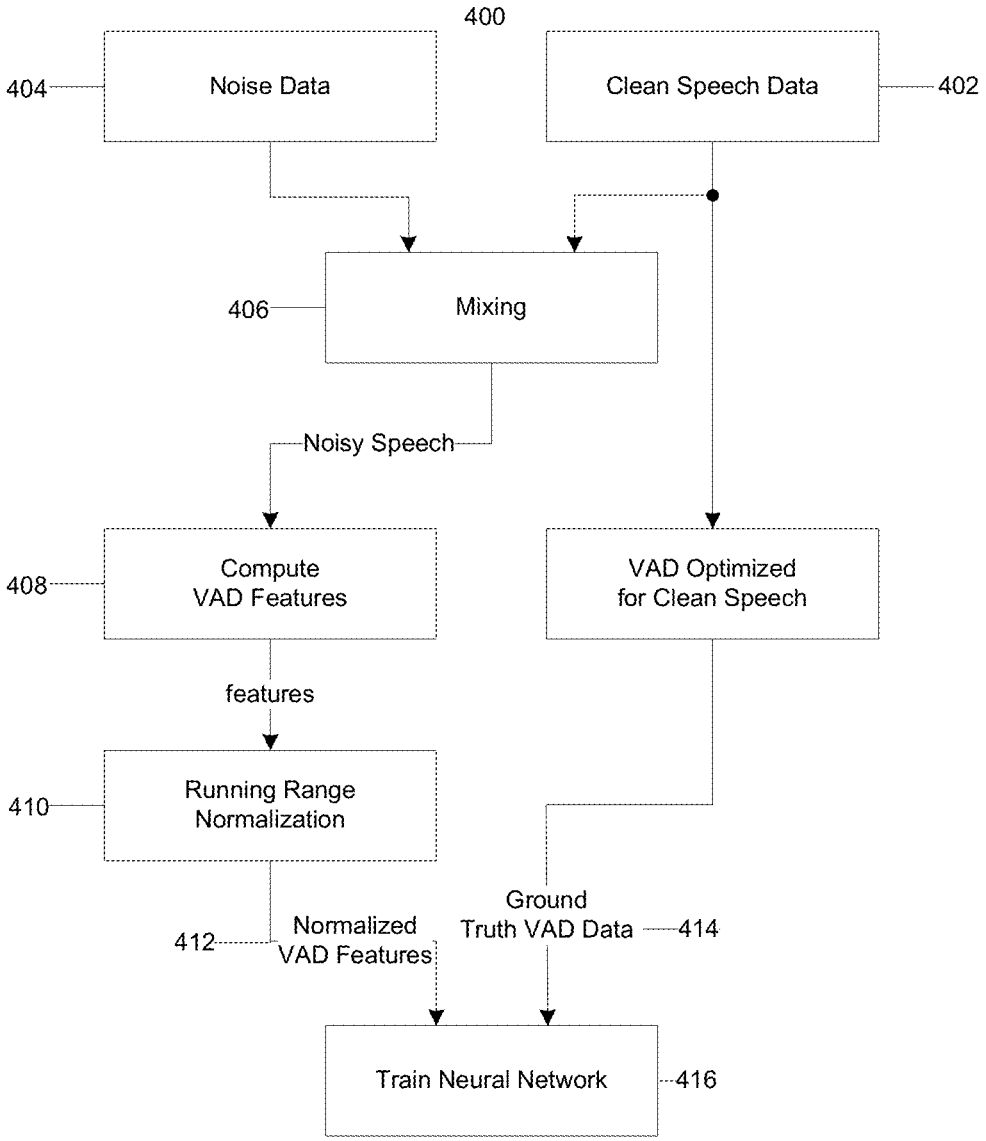
FIG. 4 illustrates a method for training a voice activity detector according to one embodiment.

With reference to FIG. 4, an embodiment of a method for training a voice activity detector 400 is illustrated. A method for training a VAD 400 may include mixing clean speech data 402 with noise data 404 to produce examples of "Noisy speech" with given signal-to-noise ratios. (Step 406). Each noisy speech signal may be evaluated to determine, or compute, one or more VAD features for each time frame (at "Compute VadFeatures"). (Step 408). Using the VAD feature(s) from the most recent time frame and optionally, feature information derived from one or more previous time frames, a running range normalization process may be performed on those VAD features (at "Running range normalization"). (Step 410). The running range normalization process may include computing a feature floor estimate and a feature ceiling estimate for each time frame. By mapping the range between the feature floor estimate and the feature ceiling estimate to a desired target range, the parameters for the corresponding VAD feature may be normalized over a plurality of time frames, or over time ("normalized VAD features"). (Step 412).

"Ground truth VAD data" may be obtained by hand-marking of clean speech data, or it may be obtained from a conventional VAD whose input is the same clean speech data from which the noisy speech and VAD features were derived. (Step 414). The neural network is then trained using the normalized VAD features and the ground truth VAD data, so it can extrapolate ("learn") from the fact that certain combinations and/or sequences of normalized VAD features correspond to certain types of ground truth VAD data. (Step 416).

Figure 5:
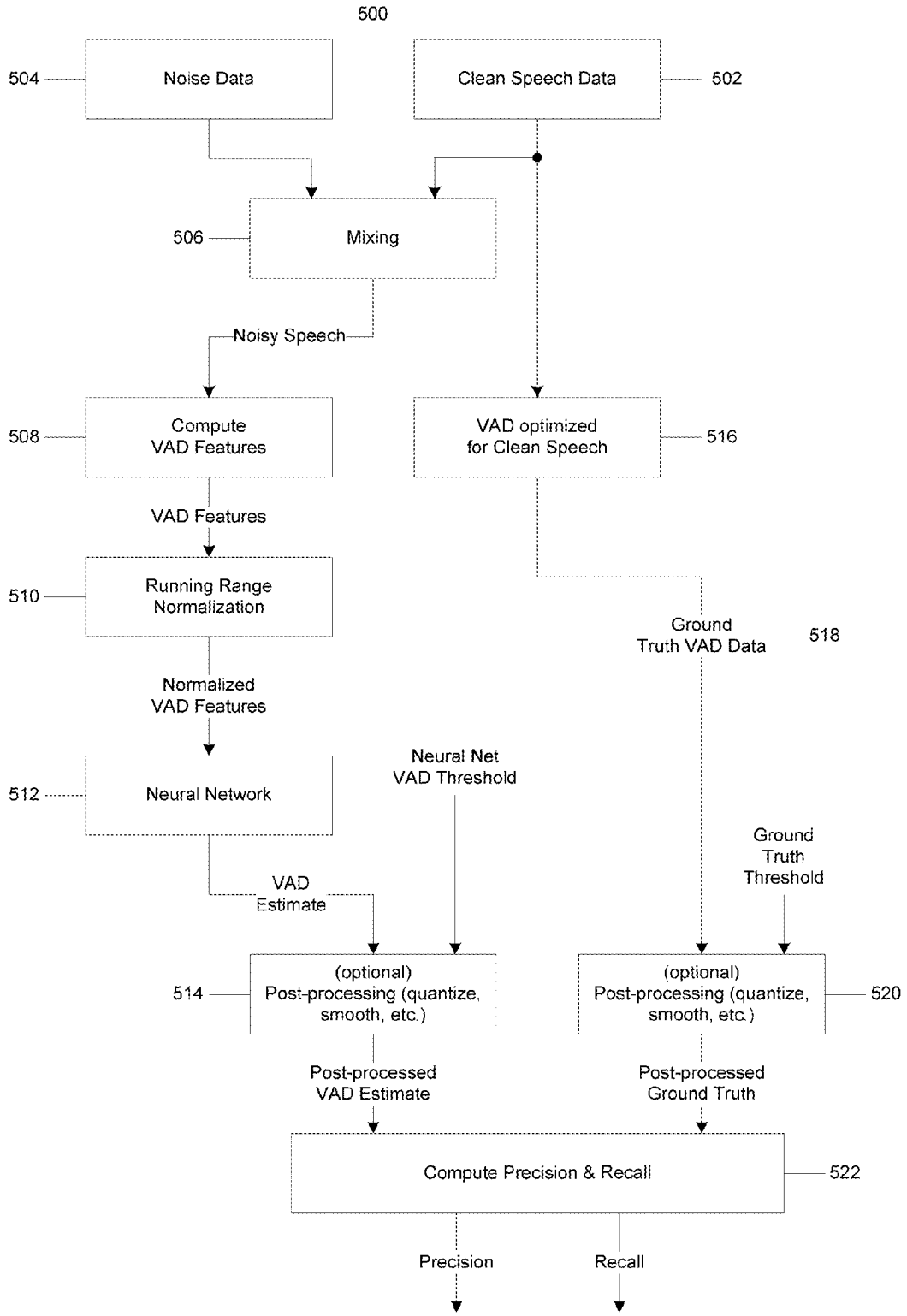
FIG. 5 illustrates a process flow of a method for testing a voice activity detector according to one embodiment.

Once a voice activity detector has been trained, the trained voice activity detector, as well as its optimized, normalized VAD features, may be tested. FIG. 5 illustrates a process flow of an embodiment of a method for testing a voice activity detector 500. Testing of a trained voice activity detector may employ one or more additional sets of clean speech data 502 (e.g., additional training signals) and noise data 504, which may be mixed together at various signal-to-noise ratios to produce noisy speech signals. (Step 506). At each time frame, a set of VAD features are computed from the noisy speech, (Step 508) and the running range normalization process is used to produce a corresponding set of normalized VAD features. (Step 210). These normalized VAD features are applied to a neural network. (Step 512). The neural network is configured and trained, to produce a VAD estimate that may optionally be smoothed, quantized, thresholded, or otherwise post-processed. (Step 514). Separately, the clean speech data is applied to a VAD optimized for clean speech (Step 516) to produce a set of ground truth VAD data 518, which may optionally be smoothed, quantized, thresholded, or otherwise post-processed. (Step 520). The (optionally post-processed) VAD estimates from the neural network and the (optionally post-processed) ground truth VAD data can be applied to a process that computes accuracy measures such as "precision" and "recall," allowing developers to fine-tune the algorithm for best performance. (Step 522).

Embodiments of the present invention may also extend to computer program products for analyzing digital data. Such computer program products may be intended for executing computer-executable instructions upon computer processors in order to perform methods for analyzing digital data. Such computer program products may comprise computer-readable media which have computer-executable instructions encoded thereon wherein the computer-executable instructions, when executed upon suitable processors within suitable computer environments, perform methods of analyzing digital data as further described herein.

Embodiments of the present invention may comprise or utilize a special purpose or general-purpose computer including computer hardware, such as, for example, one or more computer processors and data storage or system memory, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media. Computer-readable media that carry computer-executable instructions are transmission media. Thus, by way of example, and not limitation, embodiments of the invention can comprise at least two distinctly different kinds of computer-readable media: computer storage media and transmission media.

Computer storage media includes RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmission media can include a network and/or data links which can be used to carry or transmit desired program code means in the form of computer-executable instructions and/or data structures which can be received or accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or possibly primarily) make use of transmission media.

Computer-executable instructions comprise, for example, instructions and data which, when executed at a processor, cause a general purpose computer, special purpose computer, or special purpose processing device to perform a certain function or group of functions. The computer executable instructions may be, for example, binaries which may be executed directly upon a processor, intermediate format instructions such as assembly language, or even higher level source code which may require compilation by a compiler targeted toward a particular machine or processor. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Figure 6:
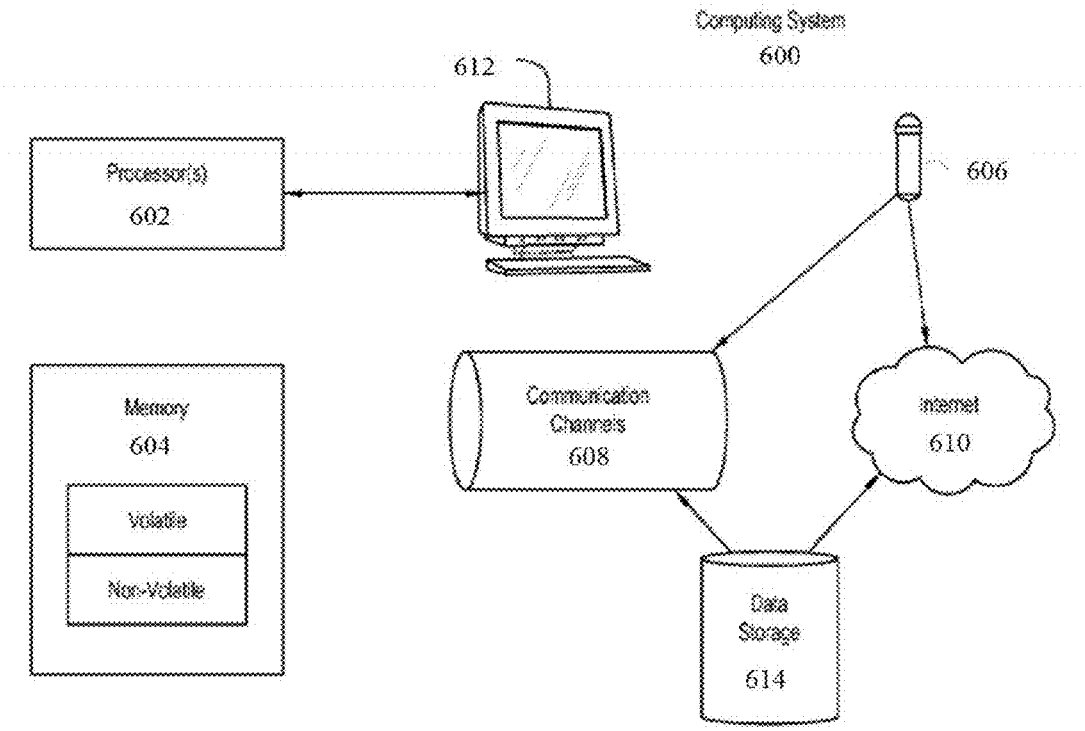
FIG. 6 illustrates a computer architecture for analyzing digital audio.

With reference to FIG. 6 an example computer architecture 600 is illustrated for analyzing digital audio data. Computer architecture 600, also referred to herein as a computer system 600, includes one or more computer processors 602 and data storage. Data storage may be memory 604 within the computing system 600 and may be volatile or non-volatile memory. Computing system 600 may also comprise a display 612 for display of data or other information. Computing system 600 may also contain communication channels 608 that allow the computing system 600 to communicate with other computing systems, devices, or data sources over, for example, a network (such as perhaps the Internet 610). Computing system 600 may also comprise an input device, such as microphone 606, which allows a source of digital or analog data to be accessed. Such digital or analog data may, for example, be audio or video data. Digital or analog data may be in the form of real time streaming data, such as from a live microphone, or may be stored data accessed from data storage 614 which is accessible directly by the computing system 600 or may be more remotely accessed through communication channels 608 or via a network such as the Internet 610.

Communication channels 608 are examples of transmission media. Transmission media typically embody computer-readable instructions, data structures, program modules, or other data in a modulated data signal such as a carrier wave or other transport mechanism and include any information-delivery media. By way of example, and not limitation, transmission media include wired media, such as wired networks and direct-wired connections, and wireless media such as acoustic, radio, infrared, and other wireless media. The term "computer-readable media" as used herein includes both computer storage media and transmission media.

Embodiments within the scope of the present invention also include computer-readable media for carrying or having computer-executable instructions or data structures stored thereon. Such physical computer-readable media, termed "computer storage media," can be any available physical media that can be accessed by a general purpose or special purpose computer. By way of example, and not limitation, such computer-readable media can comprise physical storage and/or memory media such as RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

Computer systems may be connected to one another over (or are part of) a network, such as, for example, a Local Area Network ("LAN"), a Wide Area Network ("WAN"), a Wireless Wide Area Network ("WWAN"), and even the Internet 110. Accordingly, each of the depicted computer systems as well as any other connected computer systems and their components, can create message related data and exchange message related data (e.g., Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), etc.) over the network.

Other aspects, as well as features and advantages of various aspects, of the disclosed subject matter should be apparent to those of ordinary skill in the art through consideration of the disclosure provided above, the accompanying drawings and the appended claims.

Although the foregoing disclosure provides many specifics, these should not be construed as limiting the scope of any of the ensuing claims. Other embodiments may be devised which do not depart from the scopes of the claims. Features from different embodiments may be employed in combination.

Finally, while the present invention has been described above with reference to various exemplary embodiments, many changes, combinations and modifications may be made to the embodiments without departing from the scope of the present invention. For example, while the present invention has been described for use in speech detection, aspects of the invention may be readily applied to other audio, video, data detection schemes. Further, the various elements, components, and/or processes may be implemented in alternative ways. These alternatives can be suitably selected depending upon the particular application or in consideration of any number of factors associated with the implementation or operation of the methods or system. In addition, the techniques described herein may be extended or modified for use with other types of applications and systems. These and other changes or modifications are intended to be included within the scope of the present invention.

What is claimed is:

1. A method of obtaining normalized voice activity detection features from an audio signal comprising the steps of:

at a computing system including a voice activity detector, dividing an audio signal into a sequence of time frames; computing one or more voice activity detection feature of the audio signal for each of the time frames;

computing running estimates of minimum and maximum values of the one or more voice activity detection feature of the audio signal for each of the time frames, wherein computing running estimates of minimum and maximum values of the one or more voice activity detection feature comprises applying asymmetrical exponential averaging to the one or more voice activity detection feature;

computing input ranges of the one or more voice activity detection feature by comparing the running estimates of the minimum and maximum values of the one or more voice activity detection feature of the audio signal for each of the time frames;

mapping the one or more voice activity detection feature of the audio signal for each of the time frames from the input ranges to one or more desired target range to obtain one or more normalized voice activity detection feature;

setting smoothing coefficients to correspond to time constants selected to produce one of a gradual change and a rapid change in one of smoothed minimum value estimates and smoothed maximum value estimates;

wherein the smoothing coefficients are selected such that at least one of:

continuous updating of a maximum value estimate responds rapidly to higher voice activity detection feature values and decays more slowly in response to lower voice activity detection feature values; and continuous updating of a minimum value estimate responds rapidly to lower voice activity detection feature values and increases slowly in response to higher voice activity detection feature values; and wherein the smoothing coefficients are used by the voice activity detector to detect voice activity within the audio signal.

2. The method of claim 1, wherein the one or more features of the audio signal indicative of spoken voice data includes one or more of full-band energy, low-band energy, ratios of energies measured in primary and reference microphones, variance values, spectral centroid ratios, spectral variance, variance of spectral differences, spectral flatness, and zero crossing rate.

3. The method of claim 1, wherein the one or more normalized voice activity detection feature is used to produce an estimate of the likelihood of spoken voice data.

4. The method of claim 1, further comprising applying the one or more normalized voice activity detection feature to a machine learning algorithm to produce a voice activity detection estimate indicating at least one of a binary speech/non-speech designation and a likelihood of speech activity.

5. The method of claim 4, further comprising using the voice activity detection estimate to control an adaptation rate of one or more adaptive filters without regard to a signal frequency.

6. The method of claim 1, wherein the time frames are overlapping within the sequence of time frames.

7. The method of claim 1, further comprising post-processing the one or more normalized voice activity detection feature, including at least one of smoothing, quantizing, and thresholding.

8. The method of claim 1, wherein the one or more normalized voice activity detection feature is used to enhance the audio signal by one or more of noise reduction, adaptive filtering, power level difference computation, and attenuation of non-speech frames.

9. The method of claim 1, further comprising producing a clarified audio signal comprising the spoken voice data substantially free of non-voice data.

10. The method of claim 1, wherein the one or more normalized voice activity detection feature is used to train a machine learning algorithm to detect speech.

11. The method of claim 1, further comprising initializing feature floor and ceiling estimate values to predetermined values.

12. The method of claim 1, wherein the mapping is performed according to the following formula: normalizedFeatureValue=2×(newFeatureValue−featureFloor)/(featureCeiling−featureFloor)−1.

13. The method of claim 1, wherein the mapping is performed according to the following formula: normalizedFeatureValue=(newFeatureValue−featureFloor)/(featureCeiling−featureFloor).

14. The method of claim 1, wherein the computing input ranges of the one or more voice activity detection feature is performed by subtracting the running estimates of the minimum values from the running estimates of the maximum values.

15. The method of claim 1, further comprising setting a value of at least one of a smoothing coefficient or a time constant, the setting based at least in part on comparing the one or more voice activity detection feature with one or more of the running estimates of minimum and maximum values of the one or more voice activity detection feature.

16. A method of normalizing voice activity detection features comprising the steps of:

at a computing system including a voice activity detector, segmenting an audio signal into a sequence of time frames;

computing running minimum and maximum value estimates for voice activity detection features, wherein computing running minimum and maximum value estimates for voice activity detection features comprises applying asymmetrical exponential averaging to one or more of the voice activity detection features;

computing input ranges by comparing the running minimum and maximum value estimates;

normalizing the voice activity detection features by mapping the voice activity detection features from the input ranges to one or more desired target ranges;

wherein computing running minimum and maximum value estimates comprises selecting smoothing coefficients to establish a directionally-biased rate of change for at least one of the running minimum and maximum value estimates;

wherein the smoothing coefficients are selected such that at least one of: the running maximum value estimate responds more quickly to higher maximum values and more slowly to lower maximum values and, the running minimum value estimate responds more quickly to lower minimum values and more slowly to higher minimum values; and wherein the smoothing coefficients are used by the voice activity detector to detect voice activity within the audio signal.

17. A non-transitory computer-readable medium storing a computer program for performing a method for identifying voice data within an audio signal, the non-transitory computer-readable medium comprising: computer-executable instructions stored on the non-transitory computer-readable medium, which computer-executable instructions, when executed by a computing system including a voice activity detector, are configured to cause the computing system to:

compute a plurality of voice activity detection features;

compute running estimates of minimum and maximum values of the voice activity detection features, wherein computing running minimum and maximum values of the voice activity detection features comprises applying asymmetrical exponential averaging to one or more of the voice activity detection features;

compute input ranges of the voice activity detection features by comparing the running estimates of the minimum and maximum values;

map the voice activity detection features from the input ranges to one or more desired target ranges to obtain normalized voice activity detection features;

wherein computing running estimates of minimum and maximum values comprises selecting smoothing coefficients to establish a directionally-biased rate of change for at least one of the running minimum and maximum value estimates;

wherein the smoothing coefficients are selected such that at least one of: the running maximum value estimate responds more quickly to higher maximum values and more slowly to lower maximum values and, the running minimum value estimate responds more quickly to lower minimum values and more slowly to higher minimum values; and wherein the smoothing coefficients are used by the voice activity detector to identify voice data within the audio signal.

* * * * *